US006685435B2

(12) United States Patent
Davis et al.

(10) Patent No.: US 6,685,435 B2
(45) Date of Patent: Feb. 3, 2004

(54) TURBINE BLADE ASSEMBLY WITH STRANDED WIRE CABLE DAMPERS

(75) Inventors: Gary A. Davis, Camarillo, CA (US); Gary E. Tuttle, West Hills, CA (US); Robert F. Beatty, West Hills, CA (US)

(73) Assignee: The Boeing Company, Irvine, CA (US)

( * ) Notice: Subject to any disclaimer, the term of this patent is extended or adjusted under 35 U.S.C. 154(b) by 0 days.

(21) Appl. No.: 10/133,057

(22) Filed: Apr. 26, 2002

(65) Prior Publication Data

US 2003/0202883 A1 Oct. 30, 2003

(51) Int. Cl.[7] ..... F01D 5/26

(52) U.S. Cl. ..... 416/224; 416/230; 416/229 A; 416/500

(58) Field of Search ..... 416/224, 229 R, 416/229 A, 230, 234, 500

(56) References Cited

U.S. PATENT DOCUMENTS

| | | | | | |
|---|---|---|---|---|---|
| 1,858,067 | A | * | 5/1932 | Warren | 416/196 R |
| 2,349,187 | A | * | 5/1944 | Meyer | 416/190 |
| 2,809,802 | A | * | 10/1957 | Suits | 416/230 |
| 2,999,669 | A | * | 9/1961 | McGinnis | 416/229 R |
| 4,484,859 | A | | 11/1984 | Pask et al. | |
| 5,165,860 | A | | 11/1992 | Stoner et al. | |
| 5,232,344 | A | | 8/1993 | El-Aini | |
| 5,407,321 | A | | 4/1995 | Rimkunas et al. | |
| 5,498,137 | A | | 3/1996 | El-Aini et al. | |
| 5,820,343 | A | | 10/1998 | Kraft et al. | |
| 6,155,789 | A | * | 12/2000 | Mannava et al. | 416/241 R |
| 6,283,707 | B1 | | 9/2001 | Chin | |

FOREIGN PATENT DOCUMENTS

| | | |
|---|---|---|
| GB | 2 078 310 A | 6/1980 |

* cited by examiner

*Primary Examiner*—Ninh H. Nguyen
(74) *Attorney, Agent, or Firm*—John R. Rafter

(57) ABSTRACT

A turbine blade assembly for a turbine assembly includes a turbine blade having a turbine blade damper cavity formed therein and stranded wire cable positioned within the turbine blade damper cavity. The stranded wire cable is maintained in the damper cavity during operation of the turbine blade assembly. It reduces vibration of the turbine blade assembly during operation by dissipating energy by friction between the stranded wire cable and the internal surface of the blade that defines the damper cavity. It also dissipates energy by friction between adjacent wires within the stranded wire cable.

39 Claims, 1 Drawing Sheet

TURBINE BLADE ASSEMBLY WITH STRANDED WIRE CABLE DAMPERS

BACKGROUND OF THE INVENTION

1. Field of the Invention

The present invention relates to turbines and, more particularly, to the vibration damping of turbine blades thereof.

2. Description of the Related Art

Turbines are commonly used to provide power to pump fluids, move vehicles, or generate electricity. The main power-producing component of a turbine is the turbine blade. Turbine blades are aerodynamically shaped vanes connected to the perimeter of a disk that rotates on a shaft. The blades are shaped so that, when a driving fluid passes over the surface, a force is generated causing the disk to rotate. They are usually manufactured as separate components that are subsequently attached to the disk by various means. Recently, however, turbine blades have been machined as integral parts of the disk. This one-piece integral blade/disk design is commonly referred to as a blisk.

During operation, turbine blades are subjected to alternating fluid forces that can cause high cycle fatigue failure, particularly if the frequency of the alternating force coincides with one of the natural vibration frequencies of the blade. In many instances, vibration dampers have been used to reduce the magnitude of the dynamic stresses, thereby increasing operational life. Most turbine blade vibration dampers consist of small metallic pieces that form a rubbing contact between two adjacent blades. Blade vibration causes motion at the blade/damper interfaces resulting in energy dissipation by friction. Since blisks consist of a single piece with no joints to dissipate vibration energy, they are particularly sensitive to operation near the natural frequencies of the blade/disk system. Turbine blades are designed to avoid primary resonant points but it is impossible to prevent this operation at all of the many blade natural frequencies. Therefore, additional damping must be provided to reduce resonant response of the blade/disk system.

Previous attempts to limit dynamic stresses within turbine blades have been disclosed in the patent literature. For example, U.S. Pat. No. 5,232,344, issued to Y. M. El-Aini, discloses a twisted hollow fan or compressor airfoil blade that extends radially from the rotor shaft. It has a plurality of internal chambers, each one bounded by the blade skin on two sides. A slug is located within at least one of these chambers, with the slug under the influence of centrifugal force in contact with the outboard section and also with one of the skins. It is in contact with the skins at two transversely spaced locations so that friction occurs between the two components.

U.S. Pat. No. 5,498,137, issued to Y. M. El-Aini et al., discloses a rotor blade for a turbine engine rotor assembly comprising a root, an airfoil, a platform, and apparatus for damping vibrations in the airfoil. The airfoil includes a pocket formed in a chordwise surface. The apparatus for damping vibrations in the blade includes a damper and a pocket lid. The damper is received within the pocket between an inner surface of the pocket and the pocket lid. The pocket lid is attached to the airfoil by conventional attachment apparatus and contoured to match the curvature of the airfoil.

U.S. Pat. No. 5,820,343, issued to R. J. Kraft et al., discloses a rotor blade for a rotor assembly that includes a root, an airfoil, a platform, and a damper. The airfoil includes at least one cavity. The platform extends laterally outward from the blade between the root and the airfoil, and includes an airfoil side, a root side, and an aperture extending between the root side of the platform and the cavity within the airfoil. The damper, which includes at least one bearing surface, is received within the aperture and the cavity. The bearing surface is in contact with a surface within the cavity and friction between the bearing surface and the surface within the cavity reduces vibration of the blade.

U.S. Pat. No. 5,165,860, issued to A. W. Stoner et al., discloses a turbine blade with an internal damper that comprises an elongated member with a damping surface of discrete width in contact with an interior surface of the blade. This contact is continuous throughout a contact length greater than 50% of the effective radial length. The contact is in the direction having a radial component with respect to the axis of the rotor, preferably with the damper extending between 2 degrees and 30 degrees from the radial direction. This damping surface is the exclusive frictional contact between the damper and the blade.

U.S. Pat. No. 4,484,859, issued to G. Pask et al., discloses an airfoil having a hollow portion at its tip and an internal surface of the hollow portion extending across the direction of centrifugal force acting on the blade in operation. The damper consists of a weight carried adjacent to the internal surface and free to bear on the surface under the action of centrifugal force. Should the blade vibrate, sliding movement may take place between the weight and the surface whereby the vibration of the blade is reduced.

U.S. Pat. No. 5,407,321, issued to D. A. Rimkunas et al., discloses the use of an elongated spring-like damper element that is shaped in the cross section of a "V" or "U" and inserted through a hole formed on one end of the ends of an airfoil of a stator vane. The legs of the "V" or "U" shaped element are adapted to bear against the inner surface of the airfoil and provide damping through frictional loss during vibration.

U.S. Pat. No. 6,283,707, issued to K. Chin, discloses a damper for an airfoil blade that comprises an elongated member that is inserted within a core passage in the blade. The damper is retained in the blade at the end closest to the blade root with the remainder of the damper free to move relative to and within the passage. The damper comprises a resilient plate insert upon which there are provided at least two discrete, oppositely directed, contact regions that are arranged to frictionally engage the passage.

Another proposed damping arrangement is described in GB 2078,310. In this proposal a pin is introduced within a slightly off radial extending passage provided in the airfoil portion of a blade. The pin is retained at the blade root end while being free to slide within the passage. Vibration of the blade causes relative sliding movement of the pin within the passage. Friction generated by the sliding movement absorbs energy and reduces vibration of the blade. The damping provided by this arrangement is achieved by contact between the pin and an interior passage within the blade. The pin must be closely fit to the passage and oriented at an angle to the radial direction so that a component of centripetal acceleration will force the pin to contact the wall of the passage.

SUMMARY OF THE INVENTION

The present invention is a turbine blade assembly for a turbine assembly. In a broad aspect, the turbine blade assembly includes a turbine blade having a turbine blade damper cavity formed therein. A stranded wire cable is positioned within the turbine blade damper cavity and is maintained there during operation of the turbine blade assembly. The stranded wire cable reduces vibration of the turbine blade assembly during operation by dissipating energy through friction between the cable and internal surface of the blade that define the damper cavity and also through friction between individual wires that make up the stranded cable.

This invention minimizes turbine blade high cycle fatigue failures by adding damping to reduce dynamic stresses. In a preferred embodiment, the stranded wire cable is held in place by a cap on the outer portion of the hole. During blade vibration, use of the stranded wire cable has been shown to reduce vibration stresses by as much as a factor of 20.

Most turbine blade dampers consist of separate elements that span between two adjacent blades. They provide damping by friction during relative motion of the blades. These designs are not used when the blade and disk are machined as a single entity (blisk) because the blades cannot be individually removed to install the dampers. The present invention is compatible with blisk configurations since the damper is completely contained within a single blade and does not span between adjacent blades. It is not limited to blisks and can also be used in conventional turbines where the individual blades are mechanically attached to the disk.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE INVENTION

Figure 1:
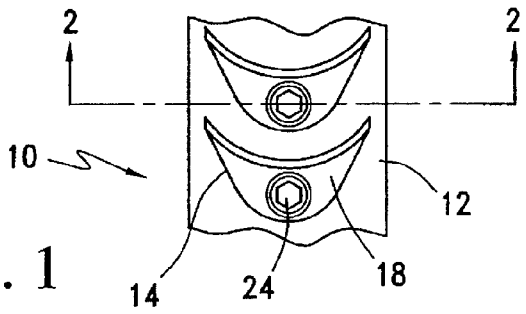
FIG. 1 is an end view of a preferred embodiment of the turbine blade assembly of the present invention.
Figure 2:
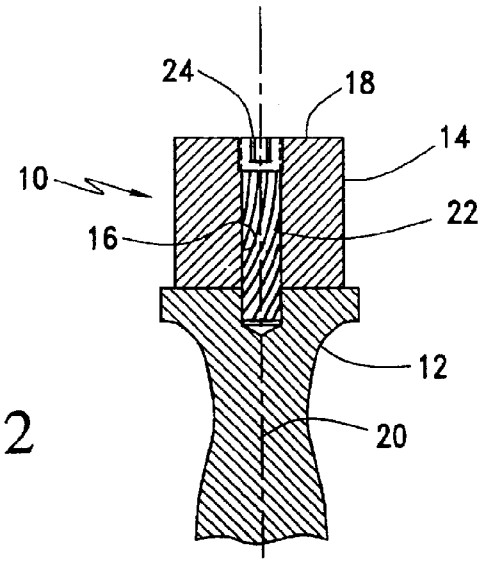
FIG. 2 is a cross-sectional view of the embodiment of FIG. 1, shown along Line 2—2 of FIG. 1.

Referring now to the drawings in the character's reference marked thereon, FIGS. 1 and 2 illustrate a preferred embodiment of the turbine blade assembly of the present invention, designated generally as 10. The turbine blade assembly 10 includes a turbine disk 12 that supports a turbine blade 14. The turbine blade 14 has an internal surface 16 defining a turbine blade damper cavity. The turbine blade damper cavity 16 extends from an opening in the distal end, i.e. tip 18, of the turbine blade 14 opposite the turbine disk 12. Damper cavity 16 may, for example, be cylindrical and extend into the turbine blade 14 substantially parallel to or along a longitudinal axis 20 of the turbine blade 14. The turbine blade longitudinal axis 20 extends substantially radially outward, i.e. radial outward or near radial outward, from the central axis of the turbine. Thus, the turbine blade longitudinal axis 20 extends in a range of about 0°–10° from the radially outward direction from the central axis. The turbine blade damper cavity 16 extends in a range of about 0°–45° from the turbine blade longitudinal axis 20.

Stranded wire cable 22 is positioned within the turbine blade damper cavity 16. The stranded wire cable may comprise a plurality of strands of wire. The number of strands is preferably in a range of about 10–25 strands. Each strand includes about 5–10 individual wires preferably formed of a ferrous-based alloy such as steel. The cable 22 dissipates energy by friction within the wire cable as well as between the walls of the cavity 16 and the outermost wires in the cable.

The stranded wire cable 22 generally has a diameter in a broad range of about 0.05–0.50 inches, preferably a range of about between about 0.10 and 0.30 inches. The specific preferred diameter is about 0.25 inches. Individual wires within the stranded wire cable 22 generally have diameters in the range of 0.010–0.040 inches. It is preferably fitted within the cavity 16 sufficiently to provide a snug fit. The size and shape of the turbine blade damper cavity 16 and stranded wire cable 22 is generally a circular cylinder, however particular embodiments may have cross sections other than circular depending on the turbine blade geometry. The turbine blade damper cavity 16 is capped after installation of the cable 22 by a damper cavity cap 24 that is firmly held into position by either screw threads, welding, or any other suitable, structurally adequate means.

The embodiment shown in FIGS. 1–2 involves machining a central cavity 16 radially inward from the distal end 18. Alternately, more than one cavity can be used. Further, the single or multiple cavities can be machined radially outwardly from the bottom of the turbine disk.

Figure 3:
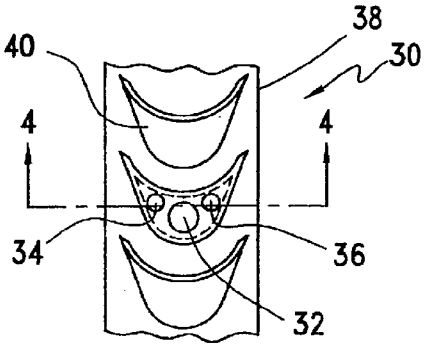
FIG. 3 is an end view of another embodiment of the turbine blade assembly of the present invention.
Figure 4:
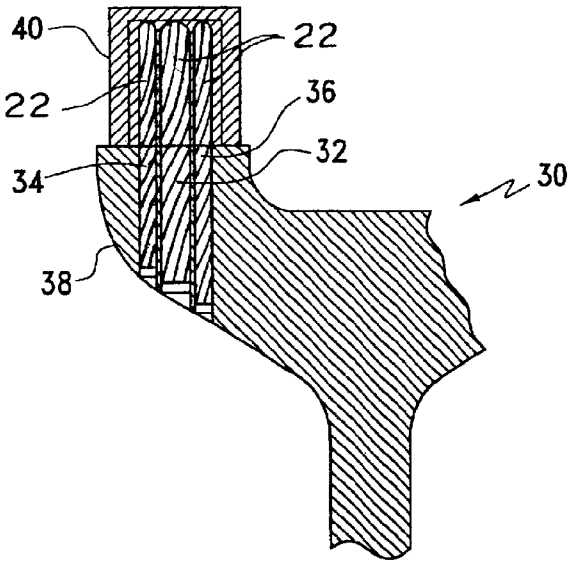
FIG. 4 is a cross-sectional view of the embodiment of FIG. 3, shown along Line 4—4 of FIG. 3.

Referring now to FIGS. 3 and 4, an alternate embodiment is illustrated, designated generally as 30. In this embodiment, three turbine blade damper cavities 32, 34, 36 are machined radially outward from the underside of the turbine disk 38 through the proximal end of the turbine blade 40. The use of a relatively large central cavity 32 and two smaller cavities 34, 36 allows maximal utilization of the volume of the turbine blade 40.

A primary advantage of the present invention is that the stranded wire cable 22 is completely contained within the turbine blade. There are no connections between blades that require external features to support the cable. Most present turbine blade dampers must span from blade to blade to use the relative motion between blades for damping. This generally restricts them to blade configurations that are mechanically attached to the disk because assembling a damper between blades requires the blades to be removable. External mounting configurations also leave the damper exposed to the high velocity gas flow, which can lead to failure of the damper. This invention allows the damper element, i.e. cable, to be placed within the turbine blade itself. The cable can be easily used on turbines with integral blades because installation of the damper cavity and cable do not require removal of the blade from the disk.

This invention can also be retrofitted to existing undamped turbine blisks. Major modification to the hardware is not required since additional material is not added to the blade to accommodate the damper cavity and cable. The retrofit only requires removing material from the blade. The modification involves making the cavity in the blade, installing the damping cable, and closing the cavity. Lead-time to return to testing is reduced since existing hardware can be modified instead of waiting for a new production run of blades.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A turbine blade assembly for a turbine assembly, said turbine assembly being rotatable about a central axis, said turbine blade assembly, comprising:

a) a turbine blade, having an internal surface defining a turbine blade damper cavity formed therein; and b) stranded wire cable positioned within said turbine blade damper cavity, said stranded wire cable being contained within each turbine blade damper cavity during operation of the turbine blade assembly, wherein said stranded wire cable reduces vibration of the turbine blade assembly during operation by dissipating energy by friction between said stranded wire cable and said internal surface and also by dissipating energy between adjacent wires within the stranded wire cable.

2. The turbine blade assembly of claim 1, wherein said turbine blade damper cavity extends into said turbine blade substantially parallel to a turbine blade longitudinal axis, said turbine blade longitudinal axis extending substantially radially outward from said central axis.

3. The turbine blade assembly of claim 2, wherein said turbine blade longitudinal axis extends in a range of about 0°–10° from the radially outward direction from said central axis.

4. The turbine blade assembly of claim 2, wherein said turbine blade damper cavity extends in a range of about 0°–45° from said turbine blade longitudinal axis.

5. The turbine blade assembly of claim 1, wherein said turbine blade assembly further comprises a turbine disk, said turbine blade and turbine disk being integrally connected to form a turbine blisk.

6. The turbine blade assembly of claim 1, wherein each said turbine blade assembly further comprises a turbine disk, said turbine blade and turbine disk being attached to each other.

7. The turbine blade assembly of claim 1, wherein said turbine blade assembly further comprises a damper cavity cap for supporting said stranded wire cable.

8. The turbine blade assembly of claim 1, wherein said turbine blade assembly further comprises a turbine disk, said turbine blade depending from said turbine disk, said damper cavity extending partially into said turbine disk.

9. The turbine blade assembly of claim 1, wherein said stranded wire cable is contained within said turbine blade damper cavity by a snug fit.

10. The turbine blade assembly of claim 1, wherein said turbine blade damper cavity extends into said turbine blade from a distal end of said turbine blade opposite a turbine disk of said turbine blade assembly.

11. The turbine blade assembly of claim 1, wherein said turbine blade assembly further comprises a turbine disk, said turbine blade depending from said turbine disk, said turbine blade damper cavity extending from an opening in said turbine disk into said turbine blade, thus allowing for the introduction of said stranded wire cable from the underside of said turbine blade.

12. The turbine blade assembly of claim 1, wherein said stranded wire cable comprises a plurality of strands of wire, energy being dissipated between adjacent strands of wire during operation.

13. The turbine blade assembly of claim 1, wherein said stranded wire cable comprises a plurality of strands of wire, said plurality of strands being in a range of about 10–25 strands.

14. The turbine blade assembly of claim 13, wherein each strand comprises a plurality of wires, said plurality of wires being in a range of about 5–10 wires.

15. The turbine blade assembly of claim 1, wherein said stranded wire cable is formed of steel wire.

16. The turbine blade assembly of claim 1, wherein said stranded wire cable is formed of a ferrous-based alloy.

17. The turbine blade assembly of claim 1, further comprising at least one additional blade damper cavity for supporting additional stranded wire cable.

18. The turbine blade assembly of claim 1, wherein said stranded wire cable comprises individual wires having diameters in a range of between about 0.010 and 0.040 inches.

19. The turbine blade assembly of claim 1, wherein said stranded wire cable has a diameter in a range of between about 0.05 and 0.30 inches.

20. The turbine blade assembly of claim 1, wherein said turbine blade comprises additional damper cavities, each containing stranded wire cable to provide maximal utilization of the volume of said turbine blade.

21. The turbine blade assembly of claim 20, wherein a relatively large central damper cavity and two smaller adjacent cavities are used.

22. A turbine blade assembly for a turbine assembly, said turbine assembly being rotatable about a central axis, said turbine blade assembly, comprising:

a) a turbine blade, having a turbine blade damper cavity formed therein, said turbine blade damper cavity extending into said turbine blade substantially along a longitudinal axis thereof, said longitudinal axis extending near radially outward from said central axis; and b) a stranded wire cable positioned within said turbine blade damper cavity parallel to said longitudinal axis of said turbine blade damper cavity, said stranded wire cable being contained within said turbine blade damper cavity during operation of the turbine blade assembly, wherein said stranded wire cable reduces vibration of the turbine blade assembly during operation by dissipating energy by friction between said stranded wire cable and said internal surface.

23. The turbine blade assembly of claim 22, wherein said turbine blade assembly further comprises a turbine disk, said turbine blade and turbine disk being integrally connected to form a turbine blisk.

24. The turbine blade assembly of claim 22, wherein said turbine blade assembly further comprises a turbine disk, said turbine blade and turbine disk being attached to each other.

25. The turbine blade assembly of claim 22, wherein said turbine blade assembly further comprises a damper cavity cap for supporting said stranded wire cable.

26. The turbine blade assembly of claim 22, wherein said turbine blade assembly further comprises a turbine disk, said turbine blade depending from said turbine disk, said damper cavity extending partially into said turbine disk.

27. The turbine blade assembly of claim 22, wherein said stranded wire cable is contained within each said turbine blade damper cavity with a snug fit.

28. The turbine blade assembly of claim 22, wherein said turbine blade damper cavity extends into said turbine blade from a distal end of said turbine blade opposite a turbine disk of said turbine blade assembly.

29. The turbine blade assembly of claim 22, wherein said turbine blade assembly further comprises a turbine disk, said turbine blade depending from said turbine disk, said turbine blade damper cavity extending from an opening in said turbine disk into said turbine blade, thus allowing for the introduction of said stranded wire cable from the underside of said turbine blade.

30. The turbine blade assembly of claim 22, wherein said stranded wire cable comprises a plurality of strands of wire.

31. The turbine blade assembly of claim 22, wherein said stranded wire cable comprises a plurality of strands of wire, said plurality of strands being in a range of about 10–25 strands.

32. The turbine blade assembly of claim 22, wherein each strand comprises a plurality of wires, said plurality of wires being in a range of about 5–10 wires.

33. The turbine blade assembly of claim 22, wherein said stranded wire cable is formed of steel wire.

34. The turbine blade assembly of claim 22, wherein said stranded wire cable is formed of a ferrous-based alloy.

35. The turbine blade assembly of claim 22, further comprising at least one additional blade damper cavity for supporting additional stranded wire cable.

36. The turbine blade assembly of claim 22, wherein said stranded wire cable comprises individual wires having diameters in a range of between about 0.010 and 0.040 inches.

37. The turbine blade assembly of claim 22, wherein said stranded wire cable has a diameter in a range of between about 0.05 and 0.30 inches.

38. A turbine blade assembly for a turbine assembly, said turbine assembly being rotatable about a central axis, said turbine blade assembly, comprising:

a) a turbine disk;

b) a plurality of turbine blades extending from said turbine disk, each turbine blade having an internal surface defining a turbine blade damper cavity formed therein; and c) stranded wire cable positioned within each of said respective turbine blade damper cavities, said stranded wire cable being contained within each turbine blade damper cavity during operation of the turbine blade assembly, wherein said stranded wire cable reduces vibration of the turbine blade assembly during operation by dissipating energy by friction between said stranded wire cable and said internal surface.

39. A method for reducing the vibration of a turbine blade assembly of a turbine assembly during operation, said turbine assembly being rotatable about a central axis, comprising the steps of:

a) forming openings in selected turbine blades so as to provide internal surfaces defining turbine blade damper cavities within said selected turbine blades;

b) positioning stranded wire cable within each of said damper cavities; and, c) containing said stranded wire cable within each damper cavity during operation of said turbine blade assembly, wherein said stranded wire cable reduces vibration of the turbine blade assembly during operation by dissipating energy by friction between said stranded wire cable and said internal surface and also by dissipating energy between adjacent wires within the stranded wire cable.

* * * * *